US012075822B2

(12) United States Patent
Wan et al.

(10) Patent No.: US 12,075,822 B2
(45) Date of Patent: Sep. 3, 2024

(54) CAPSULE FOR TOBACCO INDUSTRY PRODUCT

(71) Applicant: NICOVENTURES TRADING LIMITED, London (GB)

(72) Inventors: Peter Wan, London (GB); Frank Merzbach, London (GB); Kazuhiko Watanabe, Fujinomiya (JP); Yosuke Kondo, Fujinomiya (JP); Kenji Kato, Fujinomiya (JP)

(73) Assignee: NICOVENTURES TRADING LIMITED, London (GB)

( * ) Notice: Subject to any disclaimer, the term of this patent is extended or adjusted under 35 U.S.C. 154(b) by 63 days.

(21) Appl. No.: 16/099,320

(22) PCT Filed: May 22, 2017

(86) PCT No.: PCT/EP2017/062274
§ 371 (c)(1),
(2) Date: Nov. 6, 2018

(87) PCT Pub. No.: WO2017/198874
PCT Pub. Date: Nov. 23, 2017

(65) Prior Publication Data

US 2019/0174820 A1 Jun. 13, 2019

(30) Foreign Application Priority Data

May 20, 2016 (GB) ..... 1608943

(51) Int. Cl.
*A24D 3/06* (2006.01)
*A24B 13/00* (2006.01)
*A24B 15/28* (2006.01)

(52) U.S. Cl.
CPC ..... *A24D 3/061* (2013.01); *A24B 13/00* (2013.01); *A24B 15/283* (2013.01)

(58) Field of Classification Search
CPC ..... A24B 15/283
(Continued)

(56) References Cited

U.S. PATENT DOCUMENTS 4,889,144 A 12/1989 Tateno et al.
7,115,277 B2 * 10/2006 Firestone ..... A61K 31/4436 514/432
(Continued)

FOREIGN PATENT DOCUMENTS

CN 104585880 A 5/2015
EP 2412396 A1 2/2012
(Continued)

OTHER PUBLICATIONS

Machine Translation of ES 2281249 (Year: 2007).*
(Continued)

*Primary Examiner* — Russell E Sparks
(74) *Attorney, Agent, or Firm* — Husch Blackwell

(57) ABSTRACT

A breakable capsule for use in a tobacco industry product is disclosed. The capsule has a core-shell structure that includes a core containing both a crystallization inhibitor and at least about 35% w/w menthol, based on the total weight of the core. The crystallization inhibitor, which is different than methanol, may help reduce or inhibit the crystallization of methanol in the core-shell structure.

16 Claims, 1 Drawing Sheet

(58) Field of Classification Search
USPC ..... 131/337
See application file for complete search history.

(56) References Cited

U.S. PATENT DOCUMENTS

| | | | | |
|---|---|---|---|---|
| 7,856,988 | B2 * | 12/2010 | Yang | A24B 3/14 131/309 |
| 7,878,962 | B2 * | 2/2011 | Karles | A24D 3/0287 493/47 |
| 8,739,802 | B2 * | 6/2014 | Fagg | A24D 3/14 131/361 |
| 9,066,541 | B2 * | 6/2015 | Allen | A24D 3/061 |
| 9,999,602 | B2 * | 6/2018 | Vieth | A61K 31/593 |
| 10,244,788 | B2 * | 4/2019 | Besso | A24D 3/062 |
| 10,736,334 | B2 * | 8/2020 | Robbins | A23G 4/062 |
| 11,291,241 | B2 * | 4/2022 | Uhthurry | A24D 3/0216 |
| 2004/0261807 | A1 | 12/2004 | Dube et al. | |
| 2009/0235941 | A1 * | 9/2009 | Chida | A24D 3/061 131/275 |
| 2009/0301504 | A1 * | 12/2009 | Worthen | A23L 27/70 131/274 |
| 2011/0036367 | A1 * | 2/2011 | Saito | A24D 1/22 131/332 |
| 2011/0104218 | A1 | 5/2011 | Karles et al. | |
| 2011/0136815 | A1 | 6/2011 | Zerbe | |
| 2011/0232657 | A1 | 9/2011 | Georgios | |
| 2011/0271968 | A1 | 11/2011 | Carpenter | |
| 2012/0017926 | A1 | 1/2012 | Georgios | |
| 2014/0360518 | A1 * | 12/2014 | Besso | A24D 3/048 131/332 |
| 2015/0034099 | A1 * | 2/2015 | Besso | A24B 15/34 131/328 |
| 2015/0359264 | A1 | 12/2015 | Fernando et al. | |
| 2019/0174819 | A1 | 6/2019 | England et al. | |

FOREIGN PATENT DOCUMENTS

| | | | | |
|---|---|---|---|---|
| EP | 3039972 | | 12/2014 | |
| ES | 2281249 | A1 * | 9/2007 | A61K 31/045 |
| GB | 1349537 | | 4/1974 | |
| JP | H09233999 | A | 9/1997 | |
| JP | 2003081798 | A | 3/2003 | |
| JP | 2003339323 | A | 12/2003 | |
| JP | 2006124448 | A | 5/2006 | |
| JP | 2007259864 | A | 10/2007 | |
| JP | 2008546400 | A | 12/2008 | |
| JP | 2013-523087 | A | 6/2013 | |
| JP | 2014532435 | A | 12/2014 | |
| JP | 2014534818 | A | 12/2014 | |
| JP | 2016506934 | A | 3/2016 | |
| JP | 2016145179 | A | 8/2016 | |
| JP | 6750041 | B2 | 9/2020 | |
| KR | 20120083738 | A | 7/2012 | |
| RU | 2354355 | | 5/2009 | |
| WO | WO 2006097427 | | 9/2006 | |
| WO | WO 2007/010407 | | 1/2007 | |
| WO | WO-2009094859 | A1 | 8/2009 | |
| WO | WO 2011077314 | | 6/2011 | |
| WO | 2011116975 | A1 | 9/2011 | |
| WO | WO-2012072676 | A1 | 6/2012 | |
| WO | WO 2012156695 | | 11/2012 | |
| WO | WO 2012156703 | | 11/2012 | |
| WO | WO 2012156705 | | 11/2012 | |
| WO | WO-2013121608 | A1 | 8/2013 | |
| WO | WO-2013173469 | A1 | 11/2013 | |
| WO | 2014072735 | | 5/2014 | |
| WO | WO-2015036454 | A1 | 3/2015 | |
| WO | WO-2015128028 | A1 | 9/2015 | |
| WO | WO 2015166350 | | 11/2015 | |
| WO | WO-2015193242 | A2 | 12/2015 | |
| WO | 2016063182 | | 4/2016 | |
| WO | WO-2016063181 | A1 | 4/2016 | |

OTHER PUBLICATIONS

Machine Translation of CN 104585880 (Year: 2015).*
Required HLB for Oils/Lipids, The Herbarie, Stoney Hill Farm, Inc., https://www.theherbarie.com/public/resource-center/formulating/Required_HLB_for_Oils_and_Lipids.pdf (Year: 2009).*
R.S Verma, Essential Oil Composition of Menthol Mint (*Mentha aervensis* L.) and Peppermint (*Mentha piperita* L.) Cultivars at Different Stages of Plant Growth from Kumaon Region of Western Himalaya, Jan. 1, 2010, XP055395671, Open Access Journal of Medicinal and Aromatic Plants.
Lyle James Swift et al., Viscometric Method for Determining Free Menthol in Peppermint Oil, Industrial & Engineering Chemistry Analytical Edition, vol. 15, No. 7, Jul. 1, 1943, pp. 422-423.
International Search Report, Application No. PCT/EP2017/062274, mailed Aug. 16, 2017, 3 pages.
International Preliminary Report on Patentability for Application No. PCT/EP2017/062274, mailed on Nov. 29, 2018, 9 pages.
International Preliminary Report on Patentability for Application No. PCT/EP2017/062278, mailed on Nov. 29, 2018, 8 pages.
International Search Report and Written Opinion for Application No. PCT/EP2017/062278, mailed on Aug. 16, 2017, 10 pages.
Search Report mailed Oct. 3, 2016 for Great Britain Application No. GB1608947.6, 4 pages.
Notice of Reasons for Rejection for Japanese Application No. 2020-136205, mailed on Oct. 5, 2021, 24 pages.
Opposition Statement for Japanese Patent No. JP6750041, 50 pages.
Pandey A. K., et al., "Chemical Composition and Antimycotic Activity of the Essential Oils of Corn Mint and Lemon Grass Against Human Pathogenic Fungi," 2003, vol. 41, No. 6, pp. 421-425.
Schmidt E., et al., Natural Product Communication "Chemical Composition, Olfactory Evaluation and Antioxidant Effects of Essential Oil from Mentha x piperita," vol. 4. Issue 8, 2009, 13 pages.
RU Office Action in RU Application No. 2019137594/03, dated Feb. 28, 2023, 18 pages with English Translation.
JP Notice of Reasons for Rejection for JP Application No. 2022-181735, dated Jan. 9, 2024, 10 pages.
Office Action mailed Apr. 30, 2019 for Russian Patent Application No. 2018140731, 15 pages.
Office Action mailed Jan. 7, 2020 for Japanese Application No. 2018□555509, 5 pages.

* cited by examiner

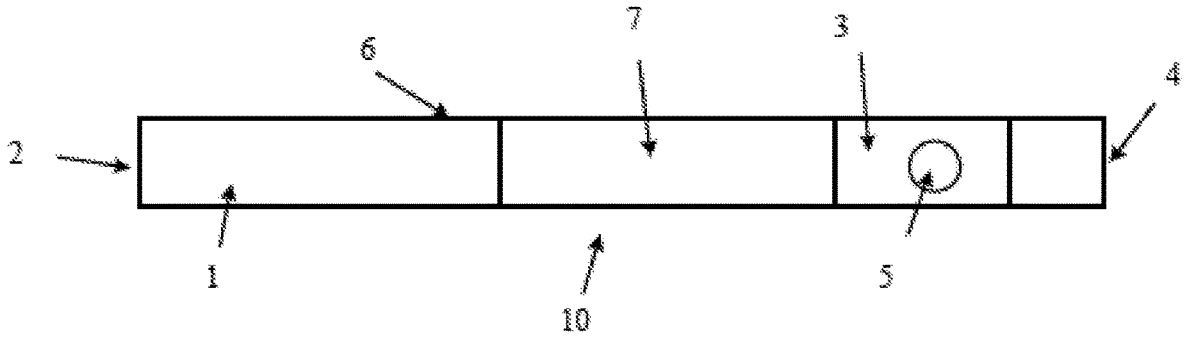
7
3
6
4
2
1
10
5

CAPSULE FOR TOBACCO INDUSTRY PRODUCT

PRIORITY CLAIM

The present application is a National Phase entry of PCT Application No. 5 PCT/EP2017/062274, filed May 22, 2017, which claims priority from GB Patent Application No. 1608943.5, filed May 20, 2016.

TECHNICAL FIELD

The present disclosure relates to a capsule for use in a tobacco industry product. It also relates to methods of making and the use of such capsules. The present disclosure also relates to tobacco industry products.

BACKGROUND

Articles such as cigarettes, cigars and the like burn tobacco during use to create tobacco smoke. Attempts have been made to provide alternatives to these types of articles, the said alternatives generating an inhalable aerosol without burning a substrate material. The material may be for example tobacco or other non-tobacco products or a combination, such as a blended mix, which may or may not contain nicotine.

An example of such aerosol generating products are the so-called heat-not-burn products, also known as tobacco heating products or tobacco heating devices, which release compounds by heating, but not burning, a solid substrate material to form an inhalable aerosol. Another example of such aerosol generating products are the so-called e-cigarette devices, which typically vaporize a liquid substrate to form an inhalable aerosol, which liquid substrate may or may not contain nicotine. Hybrid devices are also known, which vaporize both a liquid substrate and volatilize one or more components of a solid substrate material to form an inhalable aerosol.

Oral tobacco compositions are other tobacco industry products. Tobacco is typically included in a pouch that is placed into the user's mouth.

SUMMARY

At its most general, the present disclosure provides a capsule for a tobacco industry product, the capsule containing a crystallization inhibitor and menthol. Suitably, the tobacco industry product is a smoking article or a non-combustible aerosol generating device.

According to a first aspect of the present disclosure, there is provided a breakable capsule for a tobacco industry product, the capsule having a core-shell structure, and wherein the core composition comprises a crystallization inhibitor and at least about 35% w/w menthol, based on the total weight of the core. The tobacco industry product is a smoking article or a non-combustible aerosol generating device.

Menthol is used in tobacco industry products as a flavorant, improving the taste and aroma of the inhalable aerosol. Menthol is encapsulated to prevent migration of the liquid in storage.

The inventors have established that it is desirable to include menthol at high concentrations within the capsule, particularly when the capsule is for use with a smoking article or an aerosol generating device. This then allows smaller capsules to be included within the device whilst providing the same menthol load. Small capsules are desirable because they are easier to provide within the filter or consumable of the aerosol generating device, particularly where the filter or consumable is slim. However, menthol is liable to crystallize during capsule manufacture, particularly when loaded at high concentrations at ambient conditions (i.e. about 20° C. and at atmospheric pressure). Crystallization may also occur within the capsules at high menthol concentration.

The inventors have now found that including a crystallization inhibitor within the core composition allows menthol to be encapsulated at higher concentrations.

The encapsulated menthol is encapsulated in a barrier material which in some cases not only provides hindrance to migration of menthol during storage of the tobacco industry product but may also provide controlled release of the menthol during use. The capsule can be ruptured to release the menthol before or during use of the tobacco industry product.

The barrier material (also referred to herein as the encapsulating material) is frangible or breakable. The capsule is crushed or otherwise fractured or broken by the user to release the encapsulated menthol. Typically, the capsule is broken immediately prior to heating being initiated but the user can select when to release the menthol flavor (i.e. it can be crushed after heating is initiated). The barrier material creates a shell around the core composition, the core comprising menthol and the one or more crystallization inhibitors. The term "breakable capsule" refers to a capsule, wherein the shell can be broken by means of a pressure to release the core; more specifically the shell can be ruptured under the pressure imposed by the user's fingers (or any other pressure creating means) when the user wants to release the core of the capsule.

The core composition in the capsules described herein includes at least about 35% w/w menthol (based on the total weight of the core), suitably at least about 38% w/w menthol, 40% w/w menthol, 42% w/w menthol, 44% w/w menthol, 46% w/w menthol or 50% w/w menthol. The core composition in the capsules described herein includes less than or equal to about 70% w/w menthol (based on the total weight of the core), suitably less than or equal to about 65% w/w menthol, 60% w/w menthol, 58% w/w menthol, 56% w/w menthol or 55% w/w menthol. Illustratively, the capsule may include an amount of menthol in the range of 35-65% w/w (based on the total weight of the core), about 38-65% w/w or about 40-60% w/w.

The capsules described herein may include at least about 4.0 mg of menthol, suitably at least about 4.5 mg menthol, 5.0 mg menthol, 5.5 mg menthol, 6.0 mg menthol, 6.5 mg menthol or 7 mg menthol.

The core composition in the capsules described herein may include at least about 5% w/w crystallization inhibitor (based on the total weight of the core), suitably at least about 10% w/w crystallization inhibitor, 12% w/w crystallization inhibitor, or 15% w/w crystallization inhibitor. The capsules may include no more than about 30% w/w crystallization inhibitor (based on the total weight of the core), suitably no more than about 25% w/w crystallization inhibitor, 22% w/w crystallization inhibitor, or 20% w/w crystallization inhibitor. Illustratively, the capsule may include an amount of crystallization inhibitor in the range of 5-30% w/w (based on the total weight of the core), about 10-25% w/w or about 15-20% w/w.

The weight ratio of menthol to crystallization inhibitor in the capsule may be at least about 1.5:1, 2:1, or 2.5:1. The weight ratio of menthol to crystallization inhibitor in the capsule may be less than about 4:1, 3.5:1, or 3:1.

The inventors have found that if the concentration of the crystallization inhibitor is too low, crystallization of menthol during manufacture of the capsule remains a problem. If the concentration of the crystallization inhibitor is too high, flavor perception of the menthol is compromised.

The core composition may also comprise a solvent. Any suitable solvent may be used. The solvent may comprise tri-esters of glycerol. The esters may be esters of capric and/or caprylic acid. The solvent, where present, is different from the crystallization inhibitor.

The capsules described herein may be substantially spherical and have a diameter of at least about 0.4 mm, 0.6 mm, 0.8 mm, 1.0 mm, 2.0 mm, 2.5 mm, 2.8 mm or 3.0 mm. The diameter of the capsules may be less than about 10.0 mm, 8.0 mm, 7.0 mm, 6.0 mm, 5.5 mm, 5.0 mm, 4.5 mm, 4.0 mm, 3.5 mm or 3.2 mm. Illustratively, the capsule diameter may be in the range of about 0.4 mm to about 10.0 mm, about 0.8 mm to about 6.0 mm, about 2.5 mm to about 5.5 mm or about 2.8 mm to about 3.2 mm. In some cases, the capsule may have a diameter of about 3.0 mm. These sizes are particularly suitable for incorporation of the capsule into a tobacco industry product such as a smoking article or an aerosol generating device.

In some cases, the capsule may be smaller than about 3.2 mm, and the core composition may comprise at least about 45% w/w, 50% w/w or 55% w/w of menthol.

The total weight of a capsule described herein may be in the range of about 1 mg to about 100 mg, suitably about 5 mg to about 60 mg, about 10 mg to about 50 mg, about 15 mg to about 40 mg, or about 15 mg to about 30 mg.

The total weight of the core formulation may be in the range of about 2 mg to about 90 mg, suitably about 3 mg to about 70 mg, about 5 mg to about 25 mg, about 8 mg to about 20 mg, or about 10 mg to about 15 mg.

According to a second aspect of the disclosure, there is provided a filter for a smoking article or an aerosol generating device, the filter comprising a capsule according to the first aspect within a filter plug.

In some cases, embodiments may provide a filter precursor, for example a filter rod, comprising a plurality of filter plugs, each plug comprising a capsule according to the first aspect.

According to a third aspect of the disclosure, there is provided a consumable for an aerosol generating device, the consumable comprising a capsule according to the first aspect. In some cases, the consumable may comprise a filter according to the second aspect.

The consumable may additionally comprise one or more of an aerosol generating agent, a flavorant (in addition to the encapsulated menthol) and a tobacco material.

According to a fourth aspect of the disclosure, there is provided a tobacco industry product comprising a capsule according to the first aspect. In some cases, the tobacco industry product is a smoking article comprising a capsule according to the first aspect or a filter according to the second aspect. In some cases, the tobacco industry product is an aerosol generating device, the aerosol generating device comprising a capsule according to the first aspect, a filter according to the second aspect or a consumable according to the third aspect.

According to a further aspect of the disclosure, there is provided the use of an additive as a crystallization inhibitor in a composition comprising menthol. In particular, there is provided the use of an additive as a crystallization inhibitor in a composition comprising menthol, in a capsule comprising the menthol-containing composition. More particularly, there is provided the use of an additive as a crystallization inhibitor in a composition comprising menthol during manufacture of the capsule encapsulating the menthol-containing composition.

The disclosure also provides a method of making the capsule described herein. The disclosure also provides a method of making the filter described herein and the consumable described herein. The disclosure also provides for the use of a capsule described or a consumable described herein in a tobacco industry product, suitably a smoking article or an aerosol generating device.

BRIEF DESCRIPTION OF THE DRAWINGS

Further features and advantages of the disclosure will become apparent from the following description of embodiments of the disclosure, given by way of example only, which is made with reference to the accompanying drawings.

The FIGURE shows a consumable for use with an aerosol generating device.

DETAILED DESCRIPTION

The term "tobacco industry product" as used herein includes oral tobacco, smoking articles and aerosol generating devices. The term "smoking article" refers to combustible smoking products such as cigarettes, cigars and cigarillos. The term "aerosol generating device" refers to non-combustible aerosol generating devices such as tobacco heating products, e-cigarettes and hybrid products.

The core composition in the capsules described herein includes at least about 35% w/w menthol (based on the total weight of the core), suitably at least about 38% w/w menthol, 40% w/w menthol, 42% w/w menthol, 44% w/w menthol, 46% w/w menthol or 50% w/w menthol. The core composition in the capsules described herein includes less than or equal to about 70% w/w menthol (based on the total weight of the core), suitably less than or equal to about 65% w/w menthol, 60% w/w menthol, 58% w/w menthol, 56% w/w menthol or 55% w/w menthol. Illustratively, the capsule may include an amount of menthol in the range of 35-65% w/w (based on the total weight of the core), about 38-65% w/w or about 40-60% w/w.

The capsules described herein may include at least about 4.0 mg of menthol, suitably at least about 4.5 mg menthol, 5.0 mg menthol, 5.5 mg menthol, 6.0 mg menthol, 6.5 mg menthol or 7 mg menthol.

As used herein, the term "crystallization inhibitor" refers to any compound which reduces the tendency of menthol to crystallize at ambient conditions. In some cases, this reduction may amount to complete inhibition of crystallization. The crystallization inhibitor can be suitable for inhalation. The crystallization inhibitor is suitably a liquid that is mixed into the encapsulated liquid menthol or a solid dissolved within the encapsulated menthol solution. In some embodiments, the crystallization inhibitor may comprise one or more flavorants.

In some embodiments, the crystallization inhibitor comprises a mint-flavor, suitably a mint oil from any species of the genus *Mentha*.

In some cases the crystallization inhibitor may comprise one or more compounds selected from the group comprising flavorants. In one embodiment the crystallization inhibitor increases the flavor stimulation on the user.

In some cases, the crystallization inhibitor may comprise one or more compounds selected from the group comprising a mint oil from any species of the genus *Mentha*, such as peppermint oil and spearmint oil, pepper oil, vanillin, eucalyptol, limonene, $C_4$-$C_{16}$ lactones, $C_2$-$C_{14}$ esters (but not tri-esters of glycerol), $C_6$-$C_{20}$ aldehydes, $C_7$-$C_{20}$ ketones and $C_6$-$C_{20}$ alcohols. Mint-flavored crystallization inhibitors can be advantageous because they increase the mint flavor sensation and cooling effect for the user. In one embodiment the crystallization inhibitor comprises peppermint oil and spearmint oil.

The crystallization inhibitor is different from the solvent.

The core may also comprise a solvent which dissolves the menthol. Any suitable solvent may be used.

Suitably, the solvent may comprise short or medium chain fats and oils. For example, the solvent may comprise triesters of glycerol such as $C_2$-$C_{12}$ triglycerides, suitably $C_6$-$C_{10}$ triglycerides or $C_8$-$C_{12}$ triglycerides. For example, the solvent may comprise medium chain triglycerides (MCT-$C_8$-$C_{12}$), which may be derived from palm oil and/or coconut oil.

The esters may be formed with caprylic acid and/or capric acid. For example, the solvent may comprise medium chain triglycerides which are caprylic triglycerides and/or capric triglycerides. For example, the solvent may comprise compounds identified in the CAS registry by numbers 73398-61-5, 65381-09-1, 85409-09-2. Such medium chain triglycerides are odorless and tasteless.

The hydrophilic-lipophilic balance (HLB) of the solvent may be in the range of 9 to 13, suitably 10 to 12.

The encapsulated menthol is encapsulated in a barrier material, which in some cases not only provides hindrance to migration during storage of the tobacco industry product but may also provide controlled release of the menthol during use.

The barrier material (also referred to herein as the encapsulating material) is frangible or breakable. The capsule is crushed or otherwise fractured or broken by the user to release the encapsulated menthol. Typically, the capsule is broken immediately prior to heating being initiated but the user can select when the release the menthol flavor. The barrier material creates a shell around a liquid core, the liquid core comprising menthol and the one or more crystallization inhibitors. The term "breakable capsule" refers to a capsule, wherein the shell can be broken by means of a pressure to release the core; more specifically the shell can be ruptured under the pressure imposed by the user's fingers when the user wants to release the core of the capsule.

In some cases, the barrier material is heat resistant. That is to say, in some cases, the barrier will not rupture, melt or otherwise fail at the temperature reached at the capsule site during operation of the tobacco industry product, typically a smoking article or an aerosol generating device. Illustratively, a capsule located in a filter may be exposed to temperatures in the range of 30° C. to 100° C. for example, and the barrier material may continue to retain the liquid core up to at least about 50° C. to 120° C.

The total weight of a capsule described herein may be in the range of about 2 mg to about 60 mg, suitably about 5 mg to about 40 mg, about 7 mg to about 30 mg, or about 10 mg to about 20 mg. The capsule according to the invention comprises a core as described hereinbefore, and a shell. The capsule may presents a crush strength from about 4.5 N to about 40 N, suitably to about 25 N.

The total weight of the core formulation may be in the range of about 2 mg to about 30 mg, suitably about 5 mg to about 25 mg, about 8 mg to about 20 mg, or about 10 mg to about 15 mg.

The barrier material may comprise one or more of a gelling agent, a bulking agent, a buffer, a coloring agent and a plasticizer.

Suitably, the gelling agent may be, for example, a polysaccharide or cellulosic gelling agent, a gelatin, a gum, a gel, a wax or a mixture thereof. Suitable polysaccharides include alginates, dextrans, maltodextrins, cyclodextrins and pectins. Suitable alginates include, for instance, a salt of alginic acid, an esterified alginate or glyceryl alginate. Salts of alginic acid include ammonium alginate, triethanolamine alginate, and group I or II metal ion alginates like sodium, potassium, calcium and magnesium alginate. Esterified alginates include propylene glycol alginate and glyceryl alginate. In an embodiment, the barrier material is sodium alginate and/or calcium alginate. Suitable cellulosic materials include methyl cellulose, ethyl cellulose, hydroxyethyl cellulose, hydroxypropyl cellulose, carboxymethyl cellulose, cellulose acetate and cellulose ethers. The gelling agent may comprise one or more modified starches. The gelling agent may comprise carrageenans. Suitable gums include agar, gellan gum, gum Arabic, pullulan gum, mannan gum, gum ghatti, gum tragacanth, Karaya, locust bean, acacia gum, guar, quince seed and xanthan gums. Suitable gels include agar, agarose, carrageenans, furoidan and furcellaran. Suitable waxes include carnauba wax. In some cases, the gelling agent may comprise carrageenans and/or gellan gum; these gelling agents are particularly suitable for inclusion as the gelling agent as the pressure required to break the resulting capsules is particularly suitable.

The barrier material may comprise one or more bulking agents, such as starches, modified starches (such as oxidized starches) and sugar alcohols such as maltitol.

The barrier material may comprise a coloring agent which renders easier the location of the capsule within the tobacco industry product during manufacture. The coloring agent can be chosen among colorants and pigments.

The barrier material may further comprise at least one buffer, such as a citrate or phosphate compound.

The barrier material may further comprise at least one plasticizer, which may be glycerol, sorbitol, maltitol, triacetin, polyethylene glycol, propylene glycol or another polyalcohol with plasticizing properties, and optionally one acid of the monoacid, diacid or triacid type, especially citric acid, fumaric acid, malic acid, and the like. The amount of plasticizer ranges from 1% to 30% by weight, for example from 2% to 15% by weight, such as from 3 to 10% by weight of the total dry weight of the shell.

The barrier material may also comprise one or more filler materials. Suitable filler materials include comprising starch derivatives such as dextrin, maltodextrin, cyclodextrin (alpha, beta or gamma), or cellulose derivatives such as hydroxypropyl-methylcellulose (HPMC), hydroxypropylcellulose (HPC), methylcellulose (MC), carboxy-methylcellulose (CMC), polyvinyl alcohol, polyols or mixture thereof. Dextrin is a preferred filler. The amount of filler in the shell is at most 98.5%, for example from 25 to 95%, such as from 40 to 80%, or from 50 to 60% by weight on the total dry weight of the shell.

The capsule shell may additionally comprise a hydrophobic outer layer which reduces the susceptibility of the capsule to moisture-induced degradation. The hydrophobic outer layer is suitably selected from the group comprising waxes, especially carnauba wax, candelilla wax or beeswax, carbowax, shellac (in alcoholic or aqueous solution), ethyl cellulose, hydroxypropyl methyl cellulose, hydroxyl-propylcellulose, latex composition, polyvinyl alcohol, or a combination thereof. In one embodiment, the at least one moisture barrier agent is ethyl cellulose or a mixture of ethyl cellulose and shellac.

Methods of making the capsules include co-extrusion, optionally followed by centrifugation and curing and/or drying. Further details are disclosed in WO 2007/010407 A2, the contents of which are incorporated herein by reference, in its entirety.

The capsules may be located within a filter plug for a smoking article or a non-combustible aerosol generating device. The filter plug may comprise a cellulosic material such as cellulose acetate, a ceramic material, a polymer matrix and/or activated carbon. The filter plug may comprise a rod comprising first and second ends and a plurality of through-holes extending between the first and second ends. In some cases, the rod may comprise a cellulosic material, a ceramic material, a polymer and/or activated carbon.

The disclosure also provides a consumable for use in an aerosol generating device, the consumable comprising a capsule as described herein. This consumable may alternatively be referred to as a cartridge for an aerosol generating device. The consumable may additionally comprise one or more of an aerosol generating agent, a flavorant (in addition to the encapsulated menthol) and a tobacco material. The consumable may additionally comprise a filter plug, which filters out some elements of the inhalable aerosol in use. In some cases, the capsules may be located within a filter plug.

The filter plug may comprise a rod comprising first and second ends and a plurality of through-holes extending between the first and second ends. In some cases, the rod may comprise a cellulosic material such as cellulose acetate, a ceramic material such as a crystalline oxide, nitride or carbide material, a polymer and/or activated carbon. Suitable examples of ceramic materials include silicon carbide (SiC), silicon nitride ($Si_3N_4$), titanium carbide, and zirconium dioxide (zirconia).

In some cases, the consumable contains only one capsule as described herein. In other cases, the consumable contains more than one capsule as described herein. Where the consumable comprises a plurality of capsules, the individual capsules may all be provided at the same location, for example within the filter, or may be distributed through the consumable. For example, there may be one capsule in the filter and another in a tobacco portion of the consumable. Where the consumable comprises a plurality of capsules, the individual capsules may be the same as each other or may differ. For example, a plurality of capsules may be provided so that the user can select when/whether to break the capsule, thereby controlling the flavor profile.

In some cases, the consumable comprises un-encapsulated menthol. In some cases, the consumable described herein comprises at least about 7 mg of menthol, suitably at least about 8 mg menthol, 10 mg menthol, 12 mg menthol or 15 mg menthol. (These totals include encapsulated and any unencapsulated menthol.)

As illustrated in FIG. 1, the consumable 10 may be substantially cylindrical in shape. It may include a tobacco rod 1 at towards a first end 2 and a filter plug 3 towards the second end 4. Second end 4 is a mouthpiece end. The tobacco rod comprises tobacco material. The capsule 5 may be disposed within the consumable 10 adjacent to or within the filter plug 3. The filter plug may be formed from cellulose acetate. A paper sheath 6 retains the components in the cylindrical configuration and provides a passage 7 between the tobacco rod 1 and filter plug 3. A further short passage is shown between the filter plug 3 and the second end 4. This may be omitted in an alternative embodiment.

In alternative embodiments, the substantially cylindrical consumable may include the tobacco rod immediately adjacent to the filter plug. A passage may be provided on the opposite side of the filter plug to the tobacco, or there may be no passageway.

In some embodiments, the capsule may be disposed within the consumable adjacent to or within the tobacco rod.

The consumable is at least partly inserted into the aerosol generating device in use so that it can be heated to from an inhalable aerosol. The consumable may comprise a heated portion which is inserted into the aerosol generating device, and a mouthpiece portion which protrudes from the aerosol generating device, through which the aerosol is inhaled. The mouthpiece portion is not heated directly by the heater. In some cases, the capsule may be provided in the mouthpiece portion, optionally with the filter plug. In some cases, the capsule may be provided in the heated portion.

After use, the consumable is removed and typically disposed of Subsequent uses of the aerosol generating device use further consumables.

The capsules described herein are suitable for use in tobacco industry products such as smoking articles or non-combustible aerosol generating devices.

In some cases, the capsule is included in a smoking article, suitably a cigarette.

The cigarette may comprise a tobacco rod and filter element retained in a substantially cylindrical paper wrapper. In use, the smoker ignites one end of the tobacco rod and inhales smoke that through the filter. The capsule may be located in the filter, and is broken by the user before or shortly after the cigarette is lit to release the menthol flavor. In other cases, the capsule may be located adjacent to the filter, or within the tobacco rod.

In some cases, the aerosol generating device is a so-called e-cigarette device.

In some embodiments, the aerosol generating device is a so-called heat-not-burn product, also known as a tobacco heating product or tobacco heating device, which release compounds by heating, but not burning, a solid substrate material. The capsules are configured to release menthol at the operating temperature of such devices.

In further embodiments, the aerosol generating device is a hybrid e-cigarette and tobacco heating product device. In such a device, inhalable aerosol is generated by vaporizing both a liquid substrate and one or more components of a solid substrate material.

In some cases, the aerosol generating device comprises a consumable as described herein or a filter as described herein. In some cases, the aerosol generating device comprises a capsule as described herein. In some cases, the aerosol generating device contains only one capsule or consumable as described herein.

In other cases, the aerosol generating device contains more than one capsule as described herein. Where the consumable comprises a plurality of capsules, the individual capsules may be the same as each other or may differ. For example, a plurality of capsules may be provided so that the user can select when/whether to break the capsule, thereby controlling the flavor profile.

In embodiments where the aerosol generating device containing the capsule described herein is a tobacco heating product, the device may additionally contain one or more of an aerosol generating agent, a flavorant (in addition to the encapsulated menthol) and a tobacco material.

In some cases, the aerosol generating device comprises un-encapsulated menthol. In some cases, the aerosol generating device described herein comprises at least about 7 mg of menthol, suitably at least about 8 mg menthol, 10 mg menthol, 12 mg menthol or 15 mg menthol. (These totals include encapsulated and any unencapsulated menthol.)

The tobacco heating product may comprise one or more of a substrate chamber, a heater and a cooling chamber. The substrate material that is heated but not burned during use, optionally including the capsule, may be provided in the substrate chamber. The substrate chamber is heated by the heater in use to vaporize constituents of the substrate.

In an embodiment, the heater is disposed around the substrate chamber to form an oven-type arrangement in which the substrate is heated during use.

The cooling chamber is not exposed to heat in use; the one or more vaporized constituents condenses in the cooling chamber to form an aerosol. In some embodiments, the cooling chamber may be the passage 7 illustrated in FIG. 1. The cooling chamber may be in a mouthpiece portion of the aerosol generating device, and the mouthpiece portion is not exposed to the heater. The generated aerosol is inhaled through the mouthpiece portion in use. In some cases, the capsule may be included in the cooling chamber, wherein the flavorant is volatilized by residual heat in the aerosol formed from the heated substrate. A filter plug may also be provided in the cooling chamber in some embodiments.

In some cases, the capsule may be provided in the substrate chamber. The capsule may be included in the substrate chamber so that the flavorant contents are heating directly by the heater in use.

As used herein, the term "aerosol generating agent" refers to an agent that promotes the generation of an aerosol. An aerosol generating agent may promote the generation of an aerosol by promoting an initial vaporization and/or the condensation of a gas to an inhalable solid and/or liquid aerosol.

Suitable aerosol generating agents include, but are not limited to: a polyol such as sorbitol, glycerol, and glycols like propylene glycol or triethylene glycol; a non-polyol such as monohydric alcohols, high boiling point hydrocarbons, acids such as lactic acid, glycerol derivatives, esters such as diacetin, triacetin, triethylene glycol diacetate, triethyl citrate or myristates including ethyl myristate and isopropyl myristate and aliphatic carboxylic acid esters such as methyl stearate, dimethyl dodecanedioate and dimethyl tetradecanedioate.

As used herein, the terms "flavor", "flavoring" and "flavorant" refer to materials which, where local regulations permit, may be used to create a desired taste or aroma in a product for adult consumers. They may include extracts (e.g., licorice, *hydrangea*, Japanese white bark *magnolia* leaf, chamomile, fenugreek, clove, menthol, Japanese mint, aniseed, cinnamon, herb, wintergreen, cherry, berry, peach, apple, flavored liqueurs such as DRAMBUIE®, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, *cassia*, caraway, cognac, jasmine, ylang-ylang, sage, fennel, piment, ginger, anise, coriander, coffee, or a mint oil from any species of the genus Mentha), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

As used herein, the term "tobacco material" refers to any material comprising tobacco or derivatives therefore. The term "tobacco material" may include one or more of tobacco, tobacco derivatives, expanded tobacco, reconstituted tobacco or tobacco substitutes. The tobacco material may comprise one or more of ground tobacco, tobacco fiber, cut tobacco, extruded tobacco, tobacco stem, reconstituted tobacco and/or tobacco extract.

The tobacco used to produce tobacco material may be any suitable tobacco, such as single grades or blends, cut rag or whole leaf, including Virginia and/or Burley and/or Oriental. It may also be tobacco particle 'fines' or dust, expanded tobacco, stems, expanded stems, and other processed stem materials, such as cut rolled stems. The tobacco material may be a ground tobacco or a reconstituted tobacco material. The reconstituted tobacco material may comprise tobacco fibers, and may be formed by casting, a Fourdrinier-based paper making-type approach with back addition of tobacco extract, or by extrusion.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilized and modifications may be made without departing from the scope of the claimed invention. Various embodiments of the invention may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in the future.

The invention claimed is:

1. A breakable capsule for use in a tobacco industry product, the capsule comprising:

a core-shell structure with a liquid core surrounded by a shell, the liquid core comprising:

a total amount of menthol that is at least about 35% w/w;

at least about 5% w/w of a crystallization inhibitor selected from the group consisting of: pepper oil, vanillin, eucalyptol, limonene, C4-C16 lactones, C2-C14 esters but not tri-esters of glycerol, C6-C20 aldehydes, C7-C20 ketones and C6-C20 alcohols; and a solvent in which the menthol is dissolved and which is different from the crystallization inhibitor, wherein the weight percentage values are based on the total weight of the core.

2. The breakable capsule according to claim 1, wherein a hydrophilic-lipophilic balance (HLB) of the solvent is from about 9 to about 13.

3. The breakable capsule according to claim 1, wherein the solvent comprises at least one of a short chain fat, a medium chain fat, or an oil.

4. The breakable capsule according to claim 1, wherein the capsule contains at least about 38% w/w menthol.

5. The breakable capsule according to claim 1, wherein the capsule contains at least about 4 mg of menthol.

6. The breakable capsule according to claim 1, wherein the capsule contains no more than about 25% w/w crystallization inhibitor based on the total weight of the core.

7. The breakable capsule according to claim 1, wherein the capsule is substantially spherical and has a diameter between about 0.4 mm and about 10.0 mm.

8. The breakable capsule according to claim 2, wherein the HLB of the solvent is from about 10 to about 12.

9. A filter for a smoking article or aerosol generating device, the filter comprising a capsule according to claim 1 within a filter plug.

10. A consumable for an aerosol generating device, the consumable comprising a filter according to claim 9.

11. A consumable for an aerosol generating device, the consumable comprising a capsule according to claim 1.

12. The consumable according to claim 11, further comprising one or more of an aerosol generating agent, a flavorant or a tobacco material.

13. A tobacco industry product comprising a consumable according to claim 11.

14. A tobacco industry product comprising a capsule according to claim 1.

15. The tobacco industry product according to claim 14, wherein the tobacco industry product is an aerosol generating device.

16. The product according to claim 15, wherein the aerosol generating device is a tobacco heating product which generates an inhalable aerosol in use by heating but not burning a tobacco material.

* * * * *